US008656878B2

(12) United States Patent
Moeck

(10) Patent No.: US 8,656,878 B2
(45) Date of Patent: Feb. 25, 2014

(54) CAM FOLLOWER FOR ACTUATING A GAS EXCHANGE VALVE

(75) Inventor: Stephan Moeck, Pretzfeld (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 21 days.

(21) Appl. No.: 13/575,111

(22) PCT Filed: Nov. 26, 2010

(86) PCT No.: PCT/EP2010/068277

§ 371 (c)(1),
(2), (4) Date: Jul. 25, 2012

(87) PCT Pub. No.: WO2011/088924

PCT Pub. Date: Jul. 28, 2011

(65) Prior Publication Data

US 2012/0291736 A1 Nov. 22, 2012

(30) Foreign Application Priority Data

Jan. 25, 2010 (DE) ..... 10 2010 005 606

(51) Int. Cl.
*F01L 1/18* (2006.01)

(52) U.S. Cl.
USPC ..... 123/90.44; 123/90.39; 74/559; 74/569

(58) Field of Classification Search
USPC ..... 123/90.39, 90.44; 74/559, 567, 569
See application file for complete search history.

(56) References Cited

U.S. PATENT DOCUMENTS

| | | | | |
|---|---|---|---|---|
| 8,104,441 | B2 * | 1/2012 | Moeck et al. | 123/90.39 |
| 2009/0078224 | A1 | 3/2009 | Smith | |

FOREIGN PATENT DOCUMENTS

| | | | |
|---|---|---|---|
| DE | 101 21 798 | A | 11/2002 |
| JP | 62 203910 | U | 12/1987 |
| JP | 2009 281217 | A | 12/2009 |

* cited by examiner

*Primary Examiner* — Ching Chang
(74) *Attorney, Agent, or Firm* — Lucas & Mercanti, LLP

(57) ABSTRACT

A cam follower for actuating a gas exchange valve of an internal combustion engine. The cam follower has a housing and a cam roller mounted in a recess of the housing for disengaging a cam of a camshaft. The cam roller is mounted radially on a bearing journal by a needle bearing that extends in the bearing bore thereof. The width of the needle bearing is significantly greater than the width of the cam roller in the region of the cam disengagement. The width of the needle bearing is also significantly greater than the width of the cam roller in the region of the bearing bore and significantly greater than the clear space between roller contact surfaces which delimit the recess and on which the cam roller runs axially with the end faces thereof.

11 Claims, 2 Drawing Sheets

Fig. 1
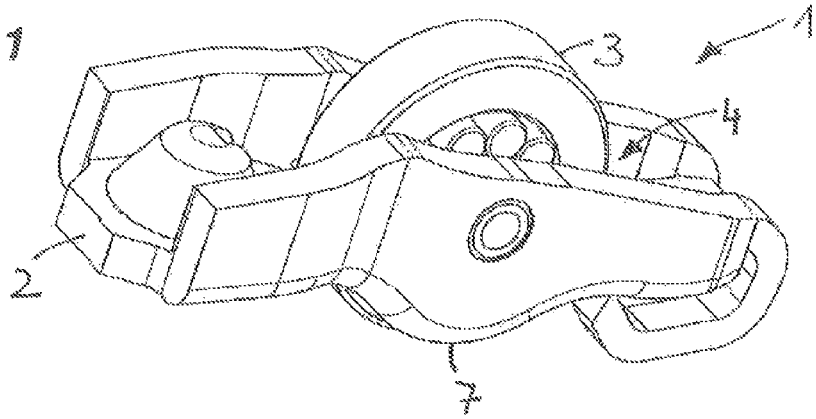
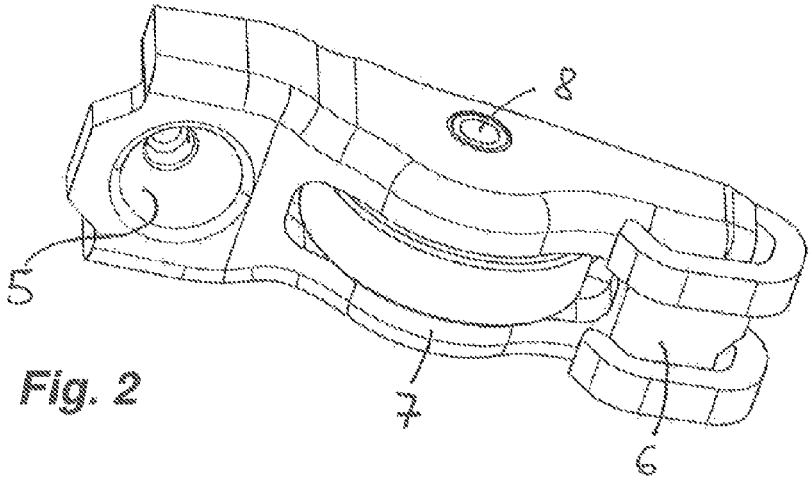
Fig. 2
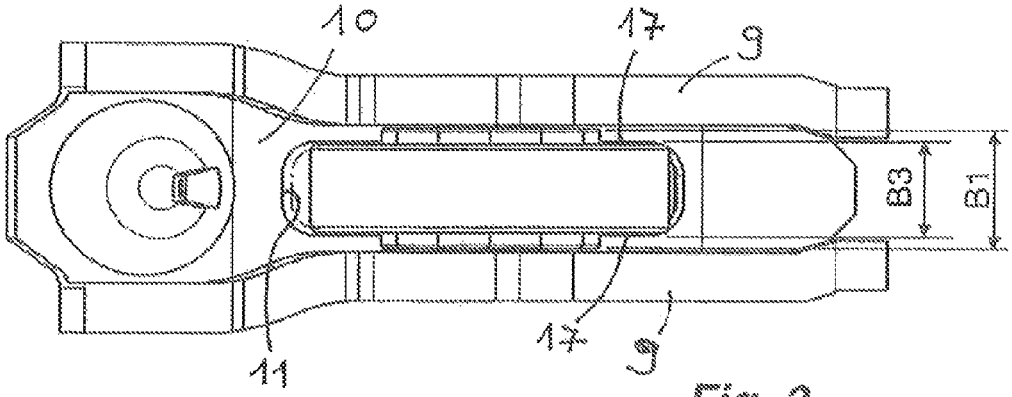
Fig. 3

CAM FOLLOWER FOR ACTUATING A GAS EXCHANGE VALVE

CROSS-REFERENCE TO RELATED APPLICATIONS

This application is a 371 of PCT/EP2010/068277 filed Nov. 26, 2010, which in turn claims the priority of DE 10 2010 005 606.5 filed Jan. 25, 2010. The priority of both applications is hereby claimed and both applications are incorporated by reference herein.

FIELD OF THE INVENTION

The invention concerns a cam follower for actuating a gas exchange valve of an internal combustion engine with a housing and a cam roller mounted in a recess of the housing for disengaging a cam of a cam shaft. The cam roller is mounted radially by means of a needle bearing running in the bearing bore thereof on a journal which spans the recess and rests on the housing, and the width of the needle bearing is significantly greater than the width of the cam roller in the region of the cam disengagement.

BACKGROUND OF THE INVENTION

A cam follower with such a cam roller is known from the generic DE 101 21 798 A1 and is suitable in particular for use in variable stroke valve assemblies with axially displaceable cam groups, the different cam protrusions of which are transferred selectively by means of the cam follower to the gas exchange valve. To guarantee the necessary clearance of an adjacent cam, i.e. one momentarily not in engagement with the cam roller, in relation to the cam roller and at the same time guarantee that the Hertzian strains in the needle bearing do not exceed the permitted load limits, the width of the cam roller in the region of the cam disengagement substantially corresponds to the width of a cam and in the region of the needle bearing corresponds to the width thereof, which is substantially greater than the width of a cam. In other words the cited prior art discloses cam followers with cam rollers stepped in diameter on both sides, the diameter steps of which have a correspondingly great width.

OBJECT SUMMARY OF THE INVENTION

The object of the present invention is to specify a cam follower of the type cited initially with a cam roller which is more favorable for production technology.

The invention relates to a cam follower for actuating a gas exchange valve of an internal combustion engine which comprises a housing and a cam roller mounted in a recess of the housing for disengaging a cam of a cam shaft. The cam roller is mounted radially by a needle bearing running in the bearing bore thereof on a bearing journal which spans the recess and rests on the housing, and the width of the needle bearing is significantly greater than the width of the cam roller in the region of the cam disengagement. The width of the needle bearing is significantly and suitably 30% to 60% larger than the width of the cam roller in the region of the bearing bore and significantly greater than the clear space between the roller contact surfaces which delimit the recess and on which the cam roller runs axially with its end faces. In contrast to the prior art cited initially, it is thus proposed that the cageless solid roller or cage-guided needle bearing protrudes from the bearing bore. The basis for this embodiment according to the invention is the fact that the Hertzian strains on the comparatively greatly curved inner raceway are significantly greater than on the comparatively slightly curved outer raceway of the needle bearing, so that the width of the cam roller in the region of the bearing bore i.e. the width of the outer raceway can be dimensioned significantly smaller than the width of the needle bearing which is decisive for the Hertzian strains, i.e. the width of the inner raceway.

In a case particularly preferable for production technology, the cam roller has flat end faces. This means that the cam roller has the same width in the region of the cam disengagement and in the region of the bearing bore, and, apart from transitional chamfers or radii to the cam disengagement surface and to the bearing bore, has no diameter steps which are costly to produce.

The axial guidance of the cam roller within the recess takes place by the roller contact surfaces, the clear spacing of which is significantly smaller than the width of the needle bearing and is selected so that the cam roller is mounted in the recess with pre-specified axial play. The roller contact surfaces are preferably positioned so that the cam roller and the needle bearing have a common transverse plane of symmetry. Disregarding the axial play of the needle bearing and cam roller, this means that the axial protrusion of the needle bearing from the bearing bore is identical on both end faces of the cam roller. Alternatively however the roller contact surfaces can also be positioned so that in relation to the needle hearing, the cam roller circulates eccentrically so that for example the needle bearing protrudes from its bearing bore only on the end face of the cam roller at which clearance is required for an adjacent cam.

The needle bearing can either roll directly on the bearing journal or on a bearing bush held on the bearing journal and which is preferably held radially sliding on the bearing journal.

The cam follower is a linear guided tappet or a centrally or end pivot-mounted rocker arm, swing or finger follower, in the case of the finger follower, its linear housing on its first end segment comprises a ball socket for holding a ball head of a supporting element pivotably supporting the finger follower, on its second end segment an actuating surface for the gas exchange valve and in its middle segment two housing segments which delimit the recess and support the bearing journal and on which run the roller contact surfaces.

With a view to favorable production costs, the housing is a sheet metal molding with a U-shaped cross-section profile which is composed of side walls running on both sides of the cam roller and a base connecting the side walls, with the ball socket and the actuating surface. Here the base has an opening for the cam roller and the roller contact surfaces are formed by the inner edges of the opening running in the longitudinal direction of the housing segments. In an alternative embodiment the roller contact surfaces are formed by spot protrusions on the mutually facing insides of the side walls. While one protrusion per side wall is sufficient for axial guidance of the cam roller, several protrusions per side wall can also be provided. The protrusions, suitably produced by embossing the side walls, can stand in spot or broad surface contact to the end faces of the cam roller.

The U-shaped cross-section profile is preferably oriented so that in relation to the base, the side wails and the ball socket protrude in the same direction. In other words the U-profile of the cam follower is dosed towards the gas exchange valve. Alternatively a U-profile open towards the gas exchange valve (inverse U-profile) can be provided in which the side walls and the ball socket protrude in opposite directions.

BRIEF DESCRIPTION OF THE DRAWINGS

Further features of the invention arise from the description below and from the drawings in which the invention is depicted with the example of two finger followers. These show:

FIG. 1 the first finger follower in perspective view from obliquely above;

FIG. 2 the first finger follower in perspective view from obliquely below;

FIG. 3 the first finger follower in view from below;

DETAILED DESCRIPTION OF THE INVENTION

Figure 4:
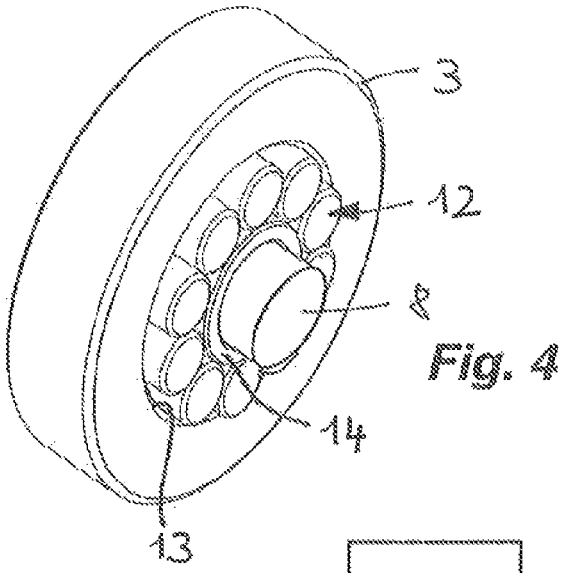
FIG. 4 the cam roller bearing of the finger followers as a detail in perspective view.

FIGS. 1 to 3 show a first embodiment example of a cam follower according to the invention for a gas exchange valve system of an internal combustion engine in various views. The cam follower formed as a finger follower 1 comprises a linear housing 2 produced from sheet metal in a cold forming process and a cam roller 3 which is mounted in a recess 4 of the housing 2 and serves for low friction disengagement of a cam from a cam shaft. The housing 2 at its first end segment has a dome-shaped ball socket 5 to hold a spherical bail head of a supporting element pivotably supporting the finger follower 1, at its second end segment an actuating surface 6 for a gas exchange valve and in its middle segment two housing segments 7 which delimit, the recess 4 and in which is supported by means of face caulking a bearing journal 8 spanning the recess 4 and radially supporting the cam roller 3.

The housing 2 has a U-shaped cross-section profile which is composed of side walls 9 running on both sides of the cam roller 3 and a base 10 connecting the side walls 9, with the ball socket 5 and the actuating surface 6. The cross-section profile is closed towards the gas exchange valve and also oriented such that in relation to the base 10, the side walls 9 and ball socket 5 protrude in the same direction. The base 10 has an opening 11 for the cam roller 3.

Figure 5:
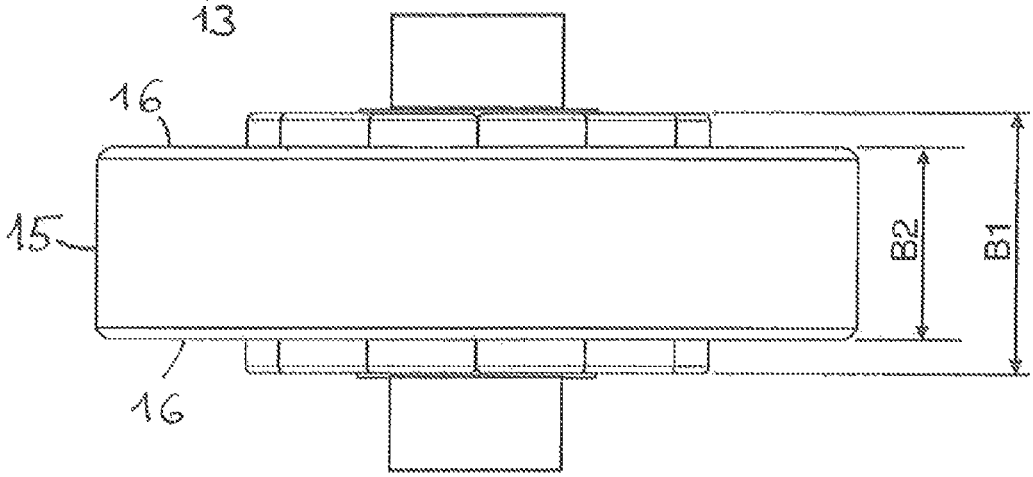
FIG. 5 the cam roller bearing according to FIG. 4 in top view.

According to FIG. 4 the cam roller 3 is mounted on the bearing journal 8 both by means of a solid roller, i.e. cageless needle bearing 12, the outer raceway of which is formed by the bearing bore 13 of the cam roller 3, and also by means of a bearing bush 14 held radially sliding on the bearing journal 8 and forming the inner raceway of the needle bearing 12. It is clear from FIG. 5 that the width B1 of the needle bearing 12 is not only significantly greater than the width B2 of the cam roller 3 in the region of the cam disengagement i.e. the width of its outer casing surface 15, but also significantly greater than the width B2 of the cam roller 3 in the region of its bearing bore 13, so that the needle hearing 12 and the bearing bush 14 protrude in relation to the end faces 16 of the cam roller 3 here formed flat. In the present case B1 is approximately 40% greater than B2.

The dimensions shown in FIG. 3 show that the width B1 of the needle bearing 12 running on the side walls 9 on the inside is also significantly greater than the clear space B3 of roller contact surfaces 17 on which the cam roller 3 runs axially with its end faces 16. The roller contact surfaces 17 are formed by the inner edges of opening 11 running in the longitudinal direction of the housing segments 7 and positioned such that the cam roller 3, needle bearing 12 and bearing bush 14 have a common transverse plane of symmetry. Ignoring the respective axial play (the axial play of cam roller 3 in the recess 4 is given by the difference B3−B2), this means that the protrusion of needle bearing 12 and bearing bush 14 out of the bearing bore 13 is identical on both end faces 16 of the cam roller 3.

Figure 6:
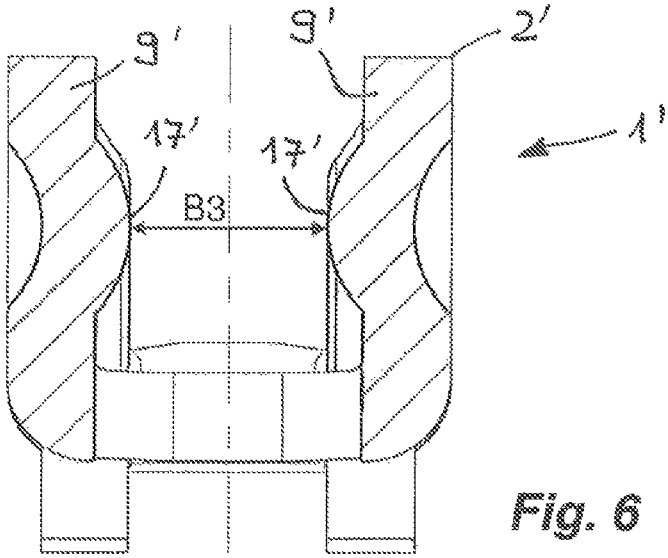
FIG. 6 the housing of the second finger follower in cross-section.

A second embodiment example of a cam follower according to the invention is shown in FIG. 6 in which only the housing 2' of the cam follower, again formed as a finger follower 1', is shown in cross-section. The finger follower 1' differs from the finger follower 1 merely by the roller contact surfaces 17' which in this case are formed by embossed spot protrusions on the mutually facing insides of side walls 9'.

A further alternative (not shown in relation to the roller contact surfaces would be to reduce the spacing of the side walls 9 to width B3 not at the second end segment of the housing 2 (as shown in FIG. 3) but already in its middle segment. In this case the end faces 16 of the cam roller 3 would run axially on the insides of the side wails running towards each other.

LIST OF REFERENCE NUMERALS

1 Cam Follower/Finger Follower
2 Housing
3 Cam Roller
4 Recess
5 Ball Socket
6 Actuating Surface
7 Housing Segment
8 Bearing Journal
9 Side Wall
10 Base
11 Opening
12 Needle Bearing
13 Bearing Bore
14 Bearing Bush
15 Outer Casing Surface of Cam Roller
16 End Face of Cam Roller
17 Roller Contact Surface
B1 Width of Needle Bearing
B2 Width of Cam Roller
B3 Clear Space between Roller Contact Surfaces

The invention claimed is:

1. A cam follower for actuating a gas exchange valve of an internal combustion engine, comprising:

a housing having a recess and roller contact surfaces which delimit the recess;

a needle bearing;

a bearing journal spanning the recess and resting on the housing; and a cam roller, which has a bearing bore and end faces, radially mounted in the recess of the housing for disengaging a cam of a earn shaft by the needle bearing running in the bearing bore on the bearing journal, the needle bearing having a width greater than a width of the cam roller in a region of cam disengagement, and the width of the needle bearing is substantially greater than the width of the cam roller in a region of the bearing bore and substantially greater than a clear space between the roller contact surfaces on which the cam roller runs axially at the end faces.

2. The cam follower as claimed in claim 1, wherein the cam roller has flat end faces.

3. The earn follower as claimed in claim 1, wherein the roller contact surfaces are positioned so that the cam roller and the needle bearing have a common transverse plane of symmetry.

4. The cam follower as claimed in claim 1, wherein the width of the needle bearing is 30% to 60% greater than the width of the cam roller in the region of the bearing bore.

5. The cam follower as claimed in claim 1, further comprising a bearing bush held on the bearing journal, wherein the needle bearing rolls on the bearing bush held on the bearing journal.

6. The cam follower as claimed in claim 5, wherein the bearing bush is held radially sliding on the bearing journal.

7. The cam follower as claimed in claim 1, wherein the cam follower is a finger follower, the housing of the finger follower comprises a ball socket on a first end segment for holding a ball head of a supporting element pivotally supporting the finger follower, an actuating surface on a second end segment for the gas exchange valve and two housing segments in a middle segment, which housing segments delimit the recess and support the bearing journal, the roller contact surfaces running on the housing segments.

8. The can follower as claimed in claim 7, wherein the housing is a sheet metal molding with a U-shaped cross-section profile which has side walls running on both sides of the cam roller and a base connecting the side walls with the ball socket and the actuating surface, the base has an opening for the cam roller, and the roller contact surfaces are formed by inner edges of the opening running in a longitudinal direction of the housing segments.

9. The cam follower as claimed in claim 8, wherein the U-shaped cross-section profile is oriented so that in relation to the base, the side walls and the ball socket protrude in a common direction.

10. The cam follower as claimed in claim 7, wherein the housing is a sheet metal molding with a U-shaped cross-section profile which has side walls running on both sides of the cam roller and a base connecting the side walls with the ball socket and the actuating surface, and wherein the roller contact surfaces are formed by spot protrusions on insides of the side walls.

11. The cam follower as claimed in claim 10, wherein the U-shaped cross-section profile is oriented so that in relation to the base, the side walls and the hall socket protrude in a common direction.

* * * * *